United States Patent [19]

Brun et al.

[11] 4,012,239

[45] Mar. 15, 1977

[54] PROCESS FOR TREATING STEEL SHEETS FOR THE PURPOSE OF ENAMELLING THE SHEETS

[75] Inventors: Charles Georges Henri Brun, Montataire; Philippe Marcel René Tirmarche, Prouvy, both of France

[73] Assignee: Union Siserurgique du Nord et de l'Est de la France, per abreviation "USINOR", Paris, France

[22] Filed: Mar. 6, 1975

[21] Appl. No.: 555,923

Related U.S. Application Data

[63] Continuation-in-part of Ser. No. 418,145, Nov. 21, 1973, abandoned.

[30] Foreign Application Priority Data

Nov. 21, 1972 France ..... 72.41241
Nov. 7, 1973 France ..... 73.39504

[52] U.S. Cl. ..... 148/6.3; 148/6.35; 148/16; 427/330; 427/376 H; 427/383 C

[51] Int. Cl.[2] ..... C23D 3/00

[58] Field of Search ..... 148/6.3, 6.35; 427/330, 427/376, 319, 383

[56] References Cited

UNITED STATES PATENTS

| | | | |
|---|---|---|---|
| 1,779,273 | 10/1930 | Hommel | 427/419 X |
| 1,857,215 | 5/1932 | Ruder | 148/6.35 X |
| 2,455,331 | 11/1948 | Eckel et al. | 427/330 X |
| 2,755,210 | 7/1956 | Sutphen et al. | 427/330 X |
| 2,878,151 | 3/1959 | Beall et al. | 427/330 X |
| 2,940,865 | 6/1960 | Sullivan | 428/432 X |
| 2,961,337 | 11/1960 | Bryant et al. | 427/330 X |
| 2,988,853 | 6/1960 | Certa | 148/6.3 X |
| 3,639,177 | 2/1972 | Tedmon et al. | 148/6.3 |

*Primary Examiner*—Ralph S. Kendall
*Attorney, Agent, or Firm*—Barry Kramer

[57] ABSTRACT

For treating a steel sheet for subsequent enamelling of the sheet with one coat of enamel: After rolling the sheet, there is deposited thereon a coat of nickel and/or cobalt, a salt of said metals or mixtures of said salts. After drying, the sheet is annealed in a decarburizing atmosphere so as to substantially totally decarburize it and, during the cooling of the annealing cycle, the coated sheet is subjected to the action of an oxidizing atmosphere containing 2 to 7% of water vapor and having an $H_2/H_2O$ ratio which is less than 6.

18 Claims, No Drawings

PROCESS FOR TREATING STEEL SHEETS FOR THE PURPOSE OF ENAMELLING THE SHEETS

The present application is a continuation-in-part of U.S. patent application Ser. No. 418,145, filed Nov. 21, 1973, now abandoned.

The present invention relates to a process for treating steel sheets for the purpose of enamelling the same.

The production of thin steel sheets adapted for the application of a single enamel coating is described in various publications from which the following known characteristics stand out:

The steel used for the application of a single enamel coating has a very low carbon content to prevent the release of CO during the baking of the enamel.

This very low carbon content may be obtained by decarburization of the coiled steel using Lee-Wilson type expanded annealing units. In this case, decarburization is obtained by action of an atmosphere consisting of a $H_2$:$H_2O$:$N_2$ mixture having the lowest possible CO and $CO_2$ contents, and the $H_2/H_2O$ ratio should be controlled within a temperature-dependent narrow range to prevent oxidation of the strip.

The more commonly used techniques involve conducting the decarburizing step at a temperature of 650°–730° C ($\alpha$ ferritic range) at a $H_2/H_2O$ ratio between 3 and 6, the $H_2$ content of the mixture being from 10% to 75%.

According to this process, the final carbon content may be reduced to less than 0.003% in the case of a steel free from any intentionally added C-binding materials (Cr, Ti, Va, Nb, W, Mo, and the like). The treatment time (from 5 to 20 hrs) is dependent on the weight of the charge treated and the thickness of the steel strip.

Hereinafter, when referring to steel bands or sheets decarburized by the Lee-Wilson process, the treatment conditions are the same as above.

Prior to the enamelling procedure, the steel band or the cut and formed sheet are treated for the purpose of improving the adhesion of the enamel.

The treatment conditions may vary greatly but always involve at least the deposition of nickel or cobalt, by displacement or electrolysis, the weight of metal deposited being within the range 0.5–5 g/m2 and more frequently within the range 0.5–2 g/m2.

In the case of single layers of light enamels which do not include nickel or cobalt oxides in their composition, this deposition is indispensable for the enamel to adhere to the steel.

When the nickel or cobalt deposition obtained by electrolysis or displacement is effected on a steel strip, it should be protected during the cutting, forming and handling of the samples to be enamelled by means of a variety of coatings described in the patent literature.

U.S. Pat. No. 2,755,210 (July 17th, 1956) and British Pat. No. 674,490 (June 25, 1952) disclose the possibility of depositing nickel or a nickel or cobalt salt on steel prior to the heat treatment and of decarburizing the thus treated sheet.

Said patents contemplate that the heat treatments conducted on the nickel plated sheet include an oxidation in the hot under a flue gas atmosphere, at a temperature of 750°–1100° C and preferably of 840° C, having a moisture content defined by a dew point within the range from 54° to 82° C and preferably of 65° C, treatment time being from 2 to 5 minutes.

The resulting material should compulsorily be submitted to a pickling step to remove the oxide formed, which creates a surface roughness to improve the adhesion of the enamel. The authors do not claim that the thus treated material maybe used under conditions different from those used in the case of conventional steels used for enamelling purposes.

An object of the present invention is to provide a product which may be pressed and directly enamelled, that is to say, a product which may be employed by the user without any preparation other than degreasing to remove the protecting oil and possibly the press greases and, in some cases, a slight pickling to facilitate the removal of the pressing residues.

Consequently, the preparation of the samples to be enamelled is considerably simplified and the equipment required is limited to a degreasing or pickling and degreasing line.

The present invention relates to a process for treating a steel sheet for the purpose of enamelling same, and particularly for direct one-coat enamelling, comprising depositing on the sheet, after rolling, a coat of a material selected from nickel and cobalt and the acetates and nitrates of said metals, in an amount of 0.45–20 g/m2 calculated as the elemental metal, annealing the sheet in a decarburizing atmosphere consisting of hydrogen, water vapour and nitrogen, the hydrogen content being 10–75% and the $H_2/H_2O$ ratio being within the range from 3 to 6, to substantially totally decarburize it and, during the cooling of the annealing cycle, subjecting the coated sheet to the action of an oxidizing atmosphere of hydrogen, water vapour and nitrogen containing 2–7% water vapour and having a $H_2/H_2O$ ratio below 6.

The deposition may be carried out after cold rolling or after pickling in the case of sheets which have been merely hot rolled. To effect this deposition, various known techniques may be used, such as displacement, reduction or electrolysis. However, such methods require careful preparation of the sheet to obtain an even deposit and degreasing followed by pickling are then necessary.

The degreasing and pickling of the sheets are conducted in the following manner.

An alkaline degreasing is effected at a temperature of 60–90° C and preferably of 75°–85° C, by dipping or spraying. This treatment is followed by a hot rinse and then a cold rinse with softened water. A continuous electrolytic degreasing step maybe substituted to this treatment.

The sheets are then pickled with dilute sulfuric acid having a concentration of 4–10%, preferably of 7–9%, by dipping or spraying.

This treatment is conducted at a temperature of 65°–85° C, preferably of 70°–80° C, and is followed by a rinse with softened water made acidic with sulfuric acid at a pH of 2–4, preferably of 2.5–3.

Both the degreasing and pickling treatments may be repeated twice, in that order; in such case, the first pickling step is effected at a lower $H_2SO_4$ concentration (preferably of 4–6%) and is followed by a cold softened water rinse instead of the acidic rinse previously described, before conducting the second alkaline degreasing and the second pickling steps.

The deposition of nickel is then effected from a nickel sulfate bath ($NiSO_4.7H_2O$) having a sulfate content of 10–30 g/liter; the pH of the solution is adjusted between pH 2.0 and pH 4, and preferably between pH 2.5 and pH 3, by addition of dilute sulfuric acid. The treatment temperature is within the range from 60° to 80° C, and preferably from 70° to 75° C.

The nickel plating treatment may be effected by dipping or spraying and is followed by a cold acidic rinse, a cold rinse and a hot rinse with softened water containing added sodium hydroxide (0.5–4 g/liter) at a temperature of 60°–80° C, and then by drying by evaporation.

All treatments in the successive baths, except the continuous line electrolytic degreasing step, last between 4 and 8 minutes, and preferably between 6 and 8 minutes. They may be carried out with expanded steel coils with intermediary wires.

During the pickling, it is desired to obtain a weight loss of 20–80 g/m2, and preferably of 30–60 g/m2.

The nickel deposition is effected to obtain a coating weight of 0.45–2.5 g/m2 and preferably of 1–1.5 g/m2.

The weight loss on pickling and the nickel content are controlled by the treatment times within the aforesaid ranges and by the P and Cu content of the treated steels.

The deposition of nickel may also be effected by reduction after degreasing and pickling, from a bath consisting of nickel sulfate $NiSO_4.7H_2O$ at a concentration of 30–35 g/l, sodium hypophosphite at a concentration of 5–10 g/liter and sodium acetate at a concentration of 10–15 g/liter; the pH is adjusted between 4 and 6; the treatment temperature is 20°–30° C, and preferably 25° C, and treatment time is 3–8 minutes.

After deposition, the subsequent steps of rinsing, neutralization and drying are conducted as indicated for the deposition of nickel by displacement.

The overall treatment may be conducted on expanded coils.

Other depositing methods may also be employed. Thus, the deposition may be carried out by immersing the sheet in, or spraying or coating the sheet with a nickel and/or cobalt salt solution, and then drying the solution to form a salt layer on the sheet.

Pickling is then no longer indispensable and the surface preparation is limited to a degreasing step to insure the good wettability of the sheet and, upon drying, to provide an even crystallization of the nickel and/or cobalt salt throughout the sheet surface.

The pre-degreasing step is conducted as described above, preferably, however, using a continuous electrolytic degreasing line; the last rinse after degreasing is effected with softened water at a temperature above 80° C.

When desired, the deposition may be limited to one side of the sheet which, in this case, is the only side capable of being enamelled.

As nickel or cobalt salt solutions, there are advantageously employed aqueous nickel and/or cobalt nitrate and acetate solutions having a concentration exceeding 100 g/liter, which solutions were found to provide good adhesion of the enamel. It has been found that the mixture of nickel and cobalt salts gives very good results and that adhesion of the enamel improves on increasing cobalt salt content. Are typically useful aqueous solutions which contain 0–300 g/liter nickel nitrate and/or acetate and 50–600 g/liter cobalt nitrate and/or acetate.

When used alone, the cobalt salts give also satisfactory adhesion results.

When the coating with the salt solution is effected by Air-less spraying, the solution is sprayed at a temperature of 60°–90° C, and preferably of 80°–85° C.

The above coating step is preferably conducted at the time of the open coil rolling up and drying of the salt which crystallizes on the band is completed during the annealing step. The conversion of the salt to metal oxide and then to metal occurs during the annealing step. The weight of salt, as the metal contained, is 1–5 g/m2 and preferably 2 g/m2.

In the case of molten nickel and/or cobalt nitrate deposition, the deposition may also be effected, after mere —preferably electrolytic— degreasing of the sheet, by spraying or coating nickel nitrate $Ni(NO_3)_2.6H_2O$, cobalt nitrate $Co(NO_3)_2.6H_2O$ or admixtures thereof in the molten state, in their water of crystallization, at a temperature of 60°–130° C.

The nitrates crystallize instantaneously upon contact with the cold strip, their temperature of solidification being about 56° C.

The salt layer deposit is then at least 20 g/m2 of crystalline metal salt on the sheet, advantageously 4–20 g/m2 calculated as the metal content and preferably 6–8 g/m2, calculated as the metal content. The conversion of the salt to metal oxide and then to metal occurs during the annealing cycle.

The sheet treated according to one of the aforedescribed processes may be annealed in a decarburizing atmosphere, in accordance with the conventional expanded coil decarburizing process of Lee-Wilson type.

The decarburizing atmosphere may typically consist of a mixture of nitrogen and hydrogen, with a hydrogen content of 10–75% and a dew point of 20°–55° C, the $H_2/H_2O$ ratio being between 3 and 6.

The duration of the decarburizing treatment is a function of the charge treated and of the thickness of the strip.

For indicative purposes: treatment time is of the order of 7 hrs for a 25 metric ton charge, the thickness of the sheet being 1 mm. During the cooling of the annealing cycle, the deposit is oxidized by an oxidizing atmosphere as previously defined; the latter treatment was found indispensable to provide good adhesion of the enamel.

According to an embodiment, when the nickel is deposited by displacement or reduction, or by electrolysis, the decarburizing annealing is conducted under the usual conditions for sheets to be enamelled, in an open-coil oven.

Heating is effected at the normal rate to the decarburizing temperature which is within the range from 650° to 730° C, and preferably from 690° to 710° C.

The annealing atmosphere is a mixture of nitrogen and hydrogen having a hydrogen content of 10–75%, preferably of 20–25%.

At the decarburizing temperature, the dew point of the gas is increased by humidification or steam injection to give a $H_2/H_2O$ ratio of 3–6, preferably 4.

The duration of the decarburizing treatment depends on the weight of the charge and the thickness of the strip, and is within the range from 5 to 20 hrs.

After the decarburizing period, cooling is effected under a wet gas, with a $H_2/H_2O$ ratio of 3–6 and preferably 4, to a temperature of 350° C.

At that temperature, the wet gas is driven out and replaced by pure nitrogen.

Oxidation of iron, which occurs between 500° and 400° C during the cooling process, gives a thin highly adherent oxide layer which it is unnecessary to remove by pickling. This oxide, which includes the nickel or the iron-nickel alloy contributes subsequently to the bonding of the direct white enamel to the steel.

According to another embodiment, when a nickel and/or cobalt salt is deposited on the strip, heating to 350° C in an open coil oven (temperature at the bottom of the charge) is slowed down to 50° C/hr and the annealing is effected with the purge open and in the absence of a flow of protecting gas, to facilitate the dissociation of the nickel and/or cobalt salts to the oxide form and the removal, by purge, of the reaction products.

Beyond that temperature level, normal heating is resumed and the annealing protecting atmosphere is admitted. This atmosphere consists of a nitrogen-hydrogen mixture with a hydrogen content of 20–75%, preferably 25–30%.

Optionally, reduction of the nickel and/or cobalt oxide occurs at 500°–650° C.

The remaining treatment steps, such as the decarburizing, nickel diffusion and oxidation steps are conducted under the previously defined conditions.

The thus annealed sheet, which is optionally subjected to a skin pass, may be directly utilized in subsequent pressing and one-coat enamelling operations according to the usual techniques.

In all the examples described hereinafter, the enamelling was carried out at 790° C with a white enamel opacified with titanium, baking time being 4 minutes.

EXAMPLE 1

Nickel coating by reduction

Sheets cold rolled with a continuous band rolling mill were used for the tests. The specimens taken after rolling were degreased and pickled as follows:

An alkaline degreasing step is effected at a temperature of 80° C by dipping or spraying. This treatment is followed by a hot rinse and then by a cold rinse with softened water. This treatment may be replaced by a continuous electrolytic degreasing step.

The degreasing step is followed by a pickling step with dilute sulfuric acid at a concentration of 8%, by dipping or spraying. This treatment is carried out at a temperature of 75° C and is followed by a rinse with softened water made acidic with sulfuric acid at a pH of about 2.8.

Both the degreasing and pickling treatments are repeated twice, in that order. The first pickling step is effected at a lower $H_2SO_4$ concentration and is followed by a cold softened water rinse instead of the previously described acidic rinse prior to effecting the second alkaline degreasing and the second pickling steps.

| Nickel coating: | |
|---|---|
| The nickel plating bath used has the following composition: | |
| Nickel sulfate ($NiSO_4.7H_2$) | 32 g/litre |
| Sodium acetate | 12 g/litre |
| Sodium hypophosphite | 7 g/litre |

The pH of the solution is adjusted between 4.5 and 5.8 and the nickel is coated at a temperature of 26° C.

The treatment may be carried out by dipping or spraying and is followed by a cold acidic rinse, a cold rinse and a hot rinse with softened water with added sodium hydroxide (0.5–4 g/liter) at 70° C, and then by drying by evaporation.

The nickel plated specimens are decarburized at 700° C by expanded annealing under a nitrogen-hydrogen atmosphere containing 20% hydrogen with a dew point adjusted at +30° C by addition of water vapour.

After decarburizing, the cooling is carried out under a wet oxidizing atmosphere containing 10% hydrogen with a dew point adjusted at +25° C.

Table I gives the results of the adhesion of the enamel to sheet specimens having thicknesses of 0.80 mm and 1.30 mm, nickel plated by reduction during 3–8 minutes and the amount of nickel deposited in g/m2.

TABLE I

| Thickness of the sheet | Nickel plating time (minutes) | Adhesion of the enamel | Amount of nickel deposited (g/m2) |
|---|---|---|---|
| 0.80 mm | 3 | nil | 0.32 |
| | 4 | good | 0.45 |
| | 5 | good | 0.53 |
| | 6 | good | 0.66 |
| | 7 | good | 0.80 |
| | 8 | good | 0.93 |
| 1.30 mm | 3 | bad | 0.26 |
| | 4 | bad | 0.40 |
| | 5 | good | 0.51 |
| | 6 | good | 0.69 |
| | 7 | very good | 0.87 |
| | 8 | very good | 1.07 |

The great flexibility of the process is apparent from the above results: thus, there is good adhesion for nickel plating times of 5–8 minutes, corresponding to a nickel plating in excess of 0.45g/m2.

For the tests tabulated in Table I, the weight losses due to the pre-pickling step were between 20 and 30 g/m2.

EXAMPLE 2

Nickel plating by displacement

The same degreased pickled sheets described in Example 1 are used for the tests.

Nickel plating is then carried out by displacement from a nickel sulfate bath ($NiSO_4.7H_2O$) at a sulfate concentration of 20 g/liter; pH of the solution is adjusted at 3 addition of dilute sulfuric acid. Treatment temperature is about 72° C.

The subsequent rinsing, neutralization, drying steps are conducted as described in Example 1.

The displacement nickel-plated sheets are then submitted to the same decarburizing and oxidizing treatment as in Example 1.

The thus treated sheets exhibit also good adhesion of the enamel for amounts of nickel plating equivalent to those of Example 1.

EXAMPLE 3

Nickel plating by dipping or spraying, with pre-pickling

Specimens 0.80 mm thick taken from sheets after cold rolling are degreased with an alkaline solution and pickled with 9% sulfuric acid.

The specimens are treated at room temperature with aqueous nickel nitrate solutions containing 600, 300 and 150 g/liter of $Ni(NO_3)_2.6H_2O$, respectively.

The specimens are treated by dipping or spraying and dried during the annealing step. The sheets are then decarburized and the nickel coating is oxidized under the same conditions as in Example 1.

The results of the adhesion of the enamel after these various treatments and the amount of nickel deposited (in g/m2) are set forth in Table II.

TABLE II

| Process of application | Treating solution | Adhesion of the enamel | Amount of nickel deposited (g/m2) |
|---|---|---|---|
| Spraying | $Ni(NO_3)_2,6H_2O$ 600 g/litre | good | 2.39 |
| | $Ni(NO_3)_2,6H_2O$ 300 g/litre | good | 2.90 |
| | $Ni(NO_3)_2,6H_2O$ 150 g/litre | good | 0.58 |
| Dipping | $Ni(NO_3)_2,6H_2O$ 600 g/litre | good | 4.73 |
| | $Ni(NO_3)_2,6H_2O$ 300 g/litre | good | 1.62 |
| | $Ni(NO_3)_2,6H_2O$ 150 g/litre | good | 0.58 |

It is apparent from the above results that the adhesion is practically unaffected by the concentration of the solution, the nickel deposits remaining in excess of 0.45g/m2.

EXAMPLE 4

Nickel salt coating by dipping or spraying, without pre-pickling

Specimens 0.80 mm thick taken from cold rolled sheets are electrolytically degreased with an alkaline solution. No pickling is carried out.

These specimens are treated with the same nickel nitrate solutions as in Example 3.

The specimens are decarburized and the nickel coat is oxidized under the same conditions as in Example 1.

The results of the adhesion of the enamel after these various treatments and the amount of nickel deposited (in g/m2) are set forth in following Table III.

TABLE III

| Process of application | Treating solution | Adhesion of the enamel | Amount of nickel deposited (g/m2) |
|---|---|---|---|
| Spraying | $Ni(NO_3)_2$, $6H_2O$ 600 g/litre | nil | 4.85 |
| | $Ni(NO_3)_2$, $6H_2O$ 300 g/litre | good | 3.54 |
| | $Ni(NO_3)_2$, $6H_2O$ 150 g/litre | good | 2.52 |
| Dipping | $Ni(NO_3)_2$, $6H_2O$ 600 g/litre | good | 2.34 |
| | $Ni(NO_3)_2$, $6H_2O$ 300 g/litre | good | 1.17 |
| | $Ni(NO_3)_2$, $6H_2O$ 150 g/litre | poor | 0.13 |

It is found that in the absence of pre-pickling, satisfactory results are nonetheless obtained provided that solutions of extreme concentrations are avoided.

EXAMPLE 5

Coating of nickel and/or cobalt salt by dipping, without pre-pickling

Specimens 0.80 mm and 1.00 mm thick taken from cold rolled sheets are degreased with an alkaline solution.

These specimens are dipped in the following nickel and cobalt nitrate based solutions, at room temperature:

| | | |
|---|---|---|
| Solution 1 | nickel nitrate $Ni(NO_3)_2,6H_2O$ | 250 g/litre |
| | cobalt nitrate $Co(NO_3)_2,6H_2O$ in aqueous solution | 50 g/litre |
| Solution 2 | nickel nitrate ($Ni(NO_3)_2,6H_2O$ | 200 g/litre |
| | cobalt nitrate $Co(NO_3)_2,6H$ O in aqueous solution | 100 g/litre |
| Solution 3 | cobalt nitrate $Co(NO_3)_2,6H_2O$ in aqueous solution | 500 g/litre |

The specimens are dried at about 150° C and decarburized, and the coating is oxidized under the conditions defined in Example 1.

The results of the adhesion of the enamel after these various treatments and the amount of nickel and cobalt deposited are set forth in following Table IV.

TABLE IV

| Treating solution | Adhesion of the enamel to 0.80 mm thick sheet | Adhesion of the enamel to 1.00 mm thick sheet | Amount of nickel deposited (g/m2) | Amount of cobalt deposited (g/m2) |
|---|---|---|---|---|
| Nickel nitrate (250 g/liter $Ni(NO_3)_2,6H_2O$) Cobalt nitrate (50 g/liter $Co(NO_3)_2,6H_2O$) | good | fair | 1.76 | 0.2 |
| Nickel nitrate (200 g/liter $Ni(NO_3)_2$, $6H_2O$) Cobalt nitrate (100 g/liter $Co(NO_3)_2,6H_2O$ | good | fair | 1.27 | 0.35 |
| Cobalt nitrate (500 g/liter $Co(NO_3)_2,6H_2O$) | good | good | 0 | 1.1 |

EXAMPLE 6

Nickel coating from molten nitrate

The treatment is carried out on extra-mild steel sheet 0.95 mm thick, electrolytically degreased in the foundry.

The specimens are treated by "Airless" spraying of nickel nitrate molten in its water of constitution ($Ni(NO_3)_2,6H_2O$ which crystallizes upon contacting the strip.

After spraying, the specimens are annealed at 700° C under a nitrogen-hydrogen mixture containing 20% hydrogen, and are then decarburized by injection of steam, the dew point being adjusted at +30° C.

While cooling under pure nitrogen, steam is again injected between 600° and 400° C to oxidize the plates (dew point adjusted at +30° C).

The results of the adhesion of the enamel to the thus treated plates are set forth in Table V below.

TABLE V

| Spraying temperature | Sprayed product | Amount of nitrate sprayed | Amount of nickel deposited | Adhesion of the enamel |
|---|---|---|---|---|
| 90° C | $Ni(NO_3)_2, 6H_2O$ | 45 g/m2 | 8.9 g/m2 | good |
| 75° C | $Ni(NO_3)_2, 6H_2O$ | 75 g/m2 | 13.7 g/m2 | good |
| 105° C | $Ni(NO_3)_2, 6H_2O$ | 37 g/m2 | 7 g/m2 | good |

EXAMPLE 7

Nickel salt coating from acetate and nitrate solutions

Specimens taken from cold rolled sheets are degreased in an alkaline solution at 100° C and optionally pickled with a 5% sulfuric acid solution at 60° C.

The specimens are treated at 90° C with aqueous nickel nitrate and acetate solutions. The salts are dried during the annealing step.

The samples are heated to 350° C at a rate of 50° C/hour without a protecting atmosphere to facilitate the dissociation of the salts to the oxides. Heating is then continued to 700° C under a dry hydrogen-nitrogen atmosphere, and the specimens are then decarburized at 700° C under a nitrogen-hydrogen-water vapour atmosphere containing 10% hydrogen, the dew point being adjusted at +30° C.

Cooling is effected under an oxidizing nitrogen-hydrogen-water vapour atmosphere at a $H_2/H_2O$ ratio between 3 and 6 and a dew point of +30° C.

When a temperature of 400° C is reached, cooling is continued under pure nitrogen.

The results of the adhesion of the enamel after these various treatments are set forth in following Table VI.

TABLE VI

| Treating solutions | | Adhesion of the enamel: Degreased pickled specimen | Adhesion of the enamel: Degreased specimen |
|---|---|---|---|
| $Ni(NO_3)_2,6H_2O$ | 100 g/liter | good | good |
| $Ni(CH_3COO)_2$ | 400 g/liter | | |
| $Ni(NO_3)_2, 6H_2O$ | 300 g/liter | good | good |
| $Ni(CH_3COO)_2$ | 100 g/liter | | |
| $Ni(NO_3)_2,6H_2O$ | 400 g/liter | good | good |
| $Ni(CH_3COO)_2$ | 100 g/liter | | |

Having now described our invention, what we claim as new and desire to secure by Letters Patent is:

1. Process for treating a steel sheet for the purpose of enamelling same and in particular directly enamelling the sheet with one coat, comprising depositing on the sheet, after rolling the sheet, a coat of a material selected from the group consisting of nickel, cobalt, and mixtures thereof, nickel acetate, nickel nitrate, cobalt acetate, cobalt nitrate and mixtures thereof in an amount of 0.45–20 g/m2 calculated as the elemental metal, annealing the sheet under a decarburizing atmosphere consisting of hydrogen, water vapour and nitrogen, the hydrogen content being 10–75% and the $H_2/H_2O$ ratio being within the range from 3 to 6, to substantially totally decarburize it and, during the cooling step of the annealing cycle, subjecting the coated sheet to the action of an oxidizing atmosphere of hydrogen, water vapour and nitrogen containing 2–7% water vapour and having a $H_2/H_2O$ ratio which is less than 6.

2. Process as claimed in claim 1, wherein the annealing is carried out in an expanded coil.

3. Process as claimed in claim 1 wherein the sheet is previously degreased and pickled and the deposition is carried out by a technique selected from the group consisting of displacement coating, reduction coating and electrolytic coating.

4. Process as claimed in claim 1 wherein the sheet is previously degreased and the deposition is carried out by a technique selected from dip coating, spray coating and flow coating of the sheet by means of a solution selected from the group consisting of nickel, nitrate, nickel acetate, cobalt nitrate, cobalt acetate and mixtures thereof and the solution is dried to give a salt layer on the sheet.

5. Process as claimed in claim 4, wherein the deposition is carried out by means of an aqueous solution selected from the group consisting of aqueous nickel nitrate, nickel acetate, cobalt nitrate and cobalt acetate solutions and mixtures thereof having a concentration in excess of 100 g/liter.

6. Process as claimed in claim 4, wherein the deposition is carried out by means of an aqueous solution selected from the group consisting of aqueous nickel nitrate and nickel acetate solutions and mixtures thereof containing 100–600 g/liter nickel salts.

7. Process as claimed in claim 4, wherein the deposition is carried out by means of a solution which is an aqueous solution optionally containing 0–300 g/liter of a material selected from the group consisting of nickel acetate, nickel nitrate and mixtures thereof and 50–600 g/liter of a material selected from the group consisting of cobalt acetate, cobalt nitrate and mixtures of cobalt acetate and cobalt nitrate.

8. Process as claimed in claim 1, comprising, after degreasing the sheet, depositing a material selected from the group consisting of nickel nitrate $Ni(NO_3)_2,6H_2O$, cobalt nitrate $Co(NO_3)_2,6H_2O$ and mixtures thereof by application of said salts in the molten state in their water of crystallization, at a temperature of 60°–130° C.

9. Process as claimed in claim 8, wherein said salts are sprayed on the sheet.

10. Process as claimed in claim 8, wherein said salts are coated on the sheet.

11. Process as claimed in claim 8, wherein the weight of the coat obtained by crystallization of the molten metal salt upon contact with the sheet, calculated as the elemental metal, is 4–20 g/m2.

12. Process for treating a steel sheet for the purpose of enamelling same and in particular directly enamelling the sheet with one coat, comprising depositing on the sheet, after rolling the sheet, a coat of a material selected from nickel acetate, nickel nitrate, cobalt acetate, cobalt nitrate and mixtures thereof, annealing the sheet to about 350° C without a protective atmosphere and then under an atmosphere consisting of hydrogen and nitrogen, the hydrogen content being 20–75%, substantially totally decarburizing the sheet at a temperature of about 650° to about 730° C, by introducing steam so as to obtain a $H_2/H_2O$ ratio comprised between 3 and 6 and, during the cooling of the annealing cycle, submitting the thus coated sheet to the action of an oxidizing atmosphere of hydrogen, steam and nitrogen having a $H_2/H_2O$ ratio which is less than 6, to a temperature of about 350° C and continuing the cooling under a pure nitrogen atmosphere.

13. Process as claimed in claim 12, wherein the coat of material selected from nickel and cobalt salts and mixtures thereof is deposited by means of an aqueous solution selected from the group consisting of aqueous solutions of nickel nitrate, nickel acetate, cobalt nitrate, cobalt acetate and mixtures thereof in an amount of 1–5 g/m2 calculated as the elemental metal.

14. Process as claimed in claim 12, comprising, after degreasing the sheet, depositing a material selected from the group consisting of nickel nitrate $Ni(NO_3)_2,6H_2O$, cobalt nitrate $Co(NO_3)_2,6H_2O$ and mixtures thereof by application of said salts in their molten state in their water of crystallization, at a temperature of 60°–130° C.

15. Process as claimed in claim 14, wherein said salts are sprayed on the sheet.

16. Process as claimed in claim 14, wherein said salts are coated on the sheet.

17. Process as claimed in claim 12, wherein the coat of molten salt selected from the group consisting of nickel salts, cobalt salts and mixtures thereof is coated in an amount of 4–20 g/m2 calculated as the elemental metal.

18. Process for treating a steel sheet for the purpose of enamelling same and in particular directly enamelling the sheet with one coat, comprising depositing on the sheet, after rolling the sheet, a coat of a material consisting of nickel, cobalt and their mixtures in an amount of 0.45–2.5 g/m2 calculated as the elemental metal, annealing the sheet under an atmosphere consisting of hydrogen and nitrogen having a hydrogen content of 10–75%, decarburizing substantially totally the sheet at a temperature of 650°–730° C, by introduction of steam to give a $H_2/H_2O$ ratio between 3 and 6 and, during the cooling of the annealing cycle, submitting the thus coated sheet to the action of an oxidizing atmosphere of hydrogen, water vapour and nitrogen having a $H_2/H_2O$ ratio which is less than 6, to a temperature of about 350° C and continuing the cooling under pure nitrogen.

* * * * *

UNITED STATES PATENT OFFICE

CERTIFICATE OF CORRECTION

Patent No. 4,012,239 Dated March 15, 1977

Inventor(s) Charles Georges Henri Brun

It is certified that error appears in the above-identified patent and that said Letters Patent are hereby corrected as shown below:

Assignee should read:

-- Union Siderurgique --.

Signed and Sealed this

Thirty-first Day of May 1977

[SEAL]

*Attest:*

RUTH C. MASON
*Attesting Officer*

C. MARSHALL DANN
*Commissioner of Patents and Trademarks*